US006199970B1

(12) United States Patent
Roy et al.

(10) Patent No.: US 6,199,970 B1
(45) Date of Patent: Mar. 13, 2001

(54) ACOUSTIC INK JET PRINTHEAD DESIGN AND METHOD OF OPERATION UTILIZING INK CROSS-FLOW

(75) Inventors: Joy Roy, San Jose; Michael C. Weisberg, Woodside; Jerry Elkin, Georgetown; Babur B. Hadimioglu, Mountain View, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/361,035

(22) Filed: Jul. 23, 1999

(51) Int. Cl.[7] ..... B41J 2/135
(52) U.S. Cl. ..... 347/46
(58) Field of Search ..... 347/46, 85, 89

(56) References Cited

U.S. PATENT DOCUMENTS 4,611,219 * 9/1986 Sugitani et al. ..... 347/85
5,028,937 * 7/1991 Khuri-Yakub et al. ..... 347/46
5,087,931 * 2/1992 Rawson ..... 347/89
5,113,205 * 5/1992 Sato et al. ..... 347/85

FOREIGN PATENT DOCUMENTS

3438033 * 4/1986 (DE) ..... 347/71

* cited by examiner

*Primary Examiner*—John Barlow
*Assistant Examiner*—Juanita Stephens
(74) *Attorney, Agent, or Firm*—Nola Mae McBain

(57) ABSTRACT

A droplet emitter with an array of droplet emitting devices constructed such that a flowing liquid used create the droplets can flow through the droplet emitter at higher flow rates. The higher flow rates prevent excess heat absorption during the droplet emission process and allow for excess heat generated by control electronics to be transferred to the flowing liquid after droplet emission but before it leaves the droplet emitter. This prevents excess heat build-up within the droplet emitter and allows for higher more accurate droplet emission.

13 Claims, 9 Drawing Sheets

ACOUSTIC INK JET PRINTHEAD DESIGN AND METHOD OF OPERATION UTILIZING INK CROSS-FLOW

INCORPORATION BY REFERENCE

The following U.S. patents are fully incorporated by reference:

U.S. Pat. No. 5,786,722 by Buhler et al. titled "Integrated RF Switching Cell Built In CMOS Technology And Utilizing A High Voltage Integrated Circuit Diode With A Charge Injecting Node" issued Jul. 28, 1998.

U.S. Pat. No. 5,565,113 by Hadimioglu et al. titled "Lithographically Defined Ejection Units" issued Oct. 15, 1996.

U.S. Pat. No. 5,389,956 by Hadimioglu et al. titled "Techniques For Improving Droplet Uniformity In Acoustic Ink Printing" issued Feb. 14, 1995.

BACKGROUND

This invention relates generally to droplet emitters and more particularly concerns an acoustically actuated droplet emitter which is provided with a continuous, high velocity, laminar flow of liquid.

FIG. 1 shows a cross-sectional view of a standard droplet emitter 10 for an acoustically actuated printer such as is shown in U.S. Pat. No. 5,565,113 by Hadimioglu et al. titled "Lithographically Defined Ejection Units" and incorporated by reference hereinabove. The droplet emitter 10 has a base substrate 12 with transducers 16 on one surface and acoustic lenses 14 on an opposite surface. Attached to the same side of the base substrate 12 as the acoustic lenses is a top support 18 with channels, defined by sidewalls 20, which hold a flowing liquid 22. Supported by the top support 18 is a capping structure 26 with arrays 24 of apertures 30. The transducers 16, acoustic lenses 14, and apertures 30 are all axially aligned such that an acoustic wave produced by a single transducer 16 will be focussed by its aligned acoustic lens 14 at approximately a free surface 28 of the liquid 22 in its aligned aperture. When sufficient power is obtained, a droplet is emitted.

FIG. 2 shows a perspective view of the droplet emitter 10 shown in FIG. 1. The arrays 24 of apertures 30 can be clearly seen on the capping structure 26. Each array 24 has a width W and a length L where the length L of the array 24 is the larger of the two dimensions. Arrow Lf shows the flow direction of the flowing liquid 22 through the top support 18, which is in the direction of the length L and orthogonal to the width W of the channels formed by sidewalls 20 and is along a length L of the arrays 24. This is due to the channels formed by sidewalls 20 being constructed such that the flowing liquid 22 flows in the direction of the length L of the each array. This configuration has many advantages. It is compact and allows the precisely aligned production of multiple arrays 24 of apertures 30 where each array is associated with a liquid having different properties. For instance, to enable a color printing application each array might be associated with a different colored ink. Furthermore, this configuration is easy to set up and attach to an ink pumping system. However, the pressure loss of the liquid 22 along the channel length L is dependent on the cross sectional area defined by sidewalls 20 and the channel length L. As the channel length L increases, the pressure loss along the flow direction increases. The portion of the pressure loss due to flow frictional losses is largely dependent upon and limited by the height h of the channel.

This pressure loss along the flow direction can become large and results in a limited flow rate. The pressure loss and the limited flow rate impacts the performance of the droplet emitter 10 by limiting the droplet emission rates possible in three ways. Firstly, the pressure loss will change the level of the free surface 28 of the flowing liquid in the apertures along the length L. At the very least, different liquid levels will contribute to focussing errors of the acoustic energy focussed by the acoustic lenses 14 and result in emitted droplets not landing in their target spots. For example, using a configuration of the type shown in FIGS. 1 and 2, with a length L of 1.7 inches and a flowing liquid having a viscosity of less than 1.3 centepoise, a flow rate which exceeds 10 ml per minute will exceed the focussing level tolerance of the acoustic lenses because the difference in meniscus position between the first and last emitter will exceed 5 microns. If the flow rate exceeds 35 ml per minute, the system can not sustain the free surface 28 of the flowing liquid 22 in the apertures 30. At these flow rates both simultaneous spilling and air bubble ingestion occurs.

Secondly, the slow flow rate will also mean that the flowing liquid 22 and the substrate 12 will heat up from the portion of the acoustic energy that is absorbed in the flowing liquid 22 and the substrate 12 which is not transferred to the kinetic and surface energy of the ejected drops. The liquid can sustain temperature increases by only a few degrees centigrade before emitted droplets show drop misplacement on the receiving media. In a worst case scenario, the flowing liquid 22 can absorb enough energy to cause it to boil. The practical consequences of this are that either the array length L, and hence the droplet emitter length must be very short to allow for faster flow rates or that the emission speed must be kept very slow to prevent the liquid from absorbing excess energy and heating up to unacceptable levels.

Using the example given above, with a configuration as shown in FIGS. 1 and 2 and a length L of 1.7 inches running under a maximum emission rate with all emitters emitting at approximately 30 watts, the temperature difference between the first and last emitter is approximately between 39 degrees centigrade and 75 degrees centigrade. This temperature differential is clearly above the preferred range of just a few degrees centigrade and affects the accuracy of droplet placement quality greatly. To correct this issue either the flow rate of the flowing liquid must be increased or the emission rate must be greatly reduced so that less heat energy is generated in the base substrate 12 and the flowing liquid 22. However, using the design shown in FIGS. 1 and 2, increasing the flow rate of the flowing liquid 22 results in an unacceptable pressure loss and meniscus position variance as discussed above. Therefore, using the design shown in FIGS. 1 and 2, emission rates must be kept low to prevent excess heating of the flowing liquid 22 to achieve acceptable drop placement accuracy.

Thirdly, if the droplet emitter is emitting droplets at high emission rates, a greater volume of fluid will be lost to droplet emission than can be replaced by the slow flow rates. Again the practical consequences of this are that either the array length L, and hence the droplet emitter length must be very short to allow for faster flow rates or that the emission speed must be kept slow to allow sufficient replenishment times.

Therefore, it would be highly desirable if a droplet emitter 10 could be designed to maintain a substantially constant pressure along the emission portion of the liquid flow path and which also has a faster flow rate for a droplet emitter array of any arbitrary length L with a minimal rise of the liquid flow temperature at high emission speeds and has sufficient liquid replenishment rates.

Further advantages of the invention will become apparent as the following description proceeds.

SUMMARY OF THE INVENTION

Briefly stated and in accordance with the present invention, there is provided a droplet emitter which has a first substrate which has been constructed to provide an array of focussed acoustic waves. The array of focussed acoustic waves has a length and a width wherein the length is greater than the width. The droplet emitter also has a second substrate which is spaced from the first substrate. The second substrate has an array of apertures which are so arranged such that each aperture may receive focussed acoustic waves. Further, there is a liquid flow chamber at least partially interposed between the first and second substrates. The liquid flow chamber has an inlet and an outlet and is constructed and arranged to receive a laminar flow of a liquid where a free surface of the liquid is formed by each of the apertures in the second substrate. The focussed acoustic waves received by each aperture are focussed substantially at the free surface of the liquid formed in the aperture. The laminar flow of liquid flows in through the inlet, out through the outlet and at least a portion of the laminar flow of liquid flows in substantially in the same direction as the length of the array of focussed acoustic waves.

Figure 1:
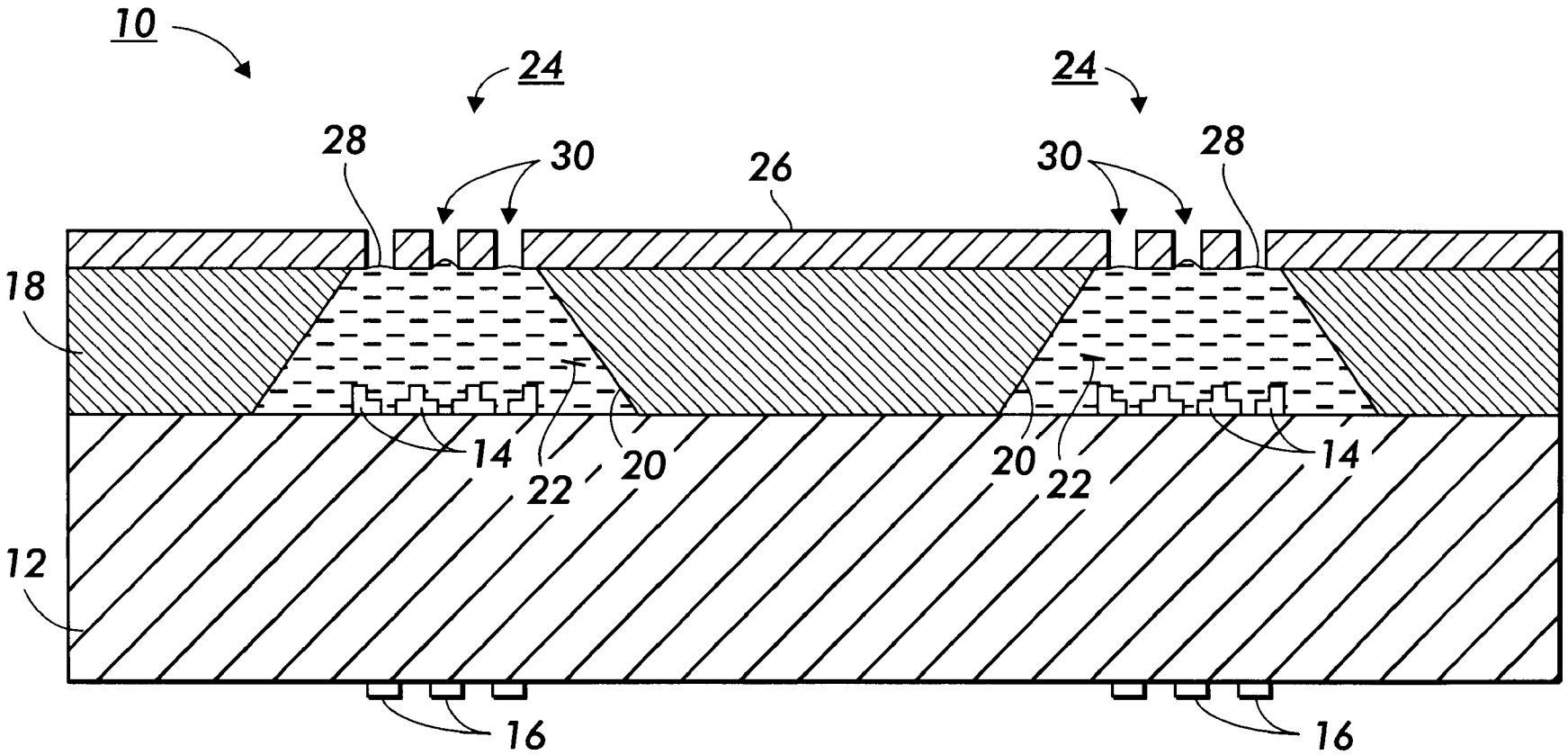
FIG. 1 PRIOR ART
FIG. 1 shows a cross-sectional view of a prior art droplet emitter for an acoustically actuated printer.

While the present invention will be described in connection with a preferred embodiment and method of use, it will be understood that it is not intended to limit the invention to that embodiment or procedure. On the contrary, it is intended to cover all alternatives, modifications and equivalents as may be included within the spirit and scope of the invention as defined by the appended claims.

ALPHA-NUMERIC LIST OF ELEMENTS h height
Hf flow direction of heat
Lf flow direction of liquid
L length of an array
W width of an array
10 droplet emitter
12 base substrate
14 acoustic lens
16 transducer
18 top support
20 sidewall
22 flowing liquid
24 array
26 capping structure
28 free surface
30 aperture
40 droplet emitter
42 base substrate
44 acoustic lens
46 transducer
48 liquid level control plate support
50 flow chamber
52 flowing liquid
54 array
56 liquid level control plate
58 free surface
60 aperture
62 fluid manifold
64 sheet flow partition
66 manifold inlet liquid tube
68 manifold outlet liquid tube
70 heat sink
72 heat conductive back plane
74 thermally conductive connection
76 circuit component
78 spring clip
80 circuit chip
82 bridge plate
84 flexible seal
86 manifold inlet
88 manifold outlet
90 liquid sheet flow chamber
92 lower manifold
94 LLC gap protrusion
96 bond wire
98 upper manifold
100 flex
102 baffle

DETAILED DESCRIPTION OF THE INVENTION

Figure 3:
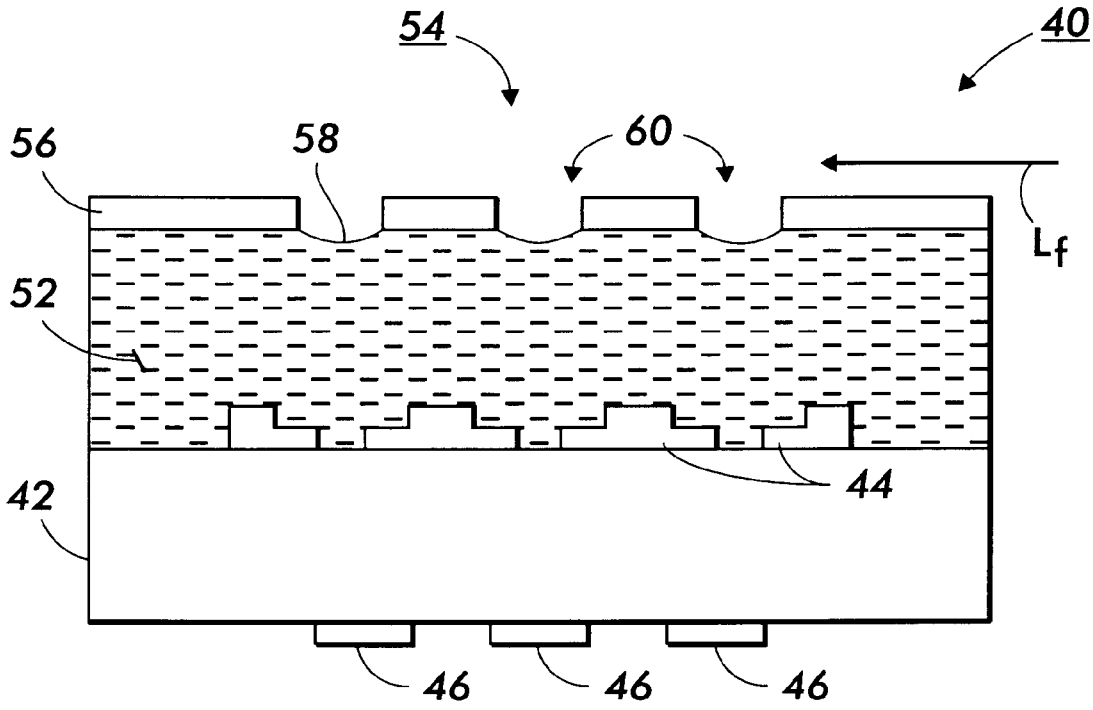
FIG. 3 show a cross-sectional view of a droplet emitter according to the present invention.

Turning now to FIG. 3, there is shown a cross-sectional view of a droplet emitter 40 configured according to the present invention. The droplet emitter 40 has a base substrate 42 with transducers 46 on one surface and acoustic lenses 44 on an opposite surface. Spaced from the base substrate 42 is a liquid level control plate 56. The base substrate 42 and the liquid level control plate 56 define a channel which holds a flowing liquid 52. The liquid level control plate 56 contains an array 54 of apertures 60. The transducers 46, acoustic lenses 44, and apertures 60 are all axially aligned such that an acoustic wave produced by a single transducer 46 will be focussed by its aligned acoustic lens 44 at approximately a free surface 58 of the liquid 52 in its aligned aperture 60. When sufficient power is obtained, a droplet is emitted.

Figure 2:
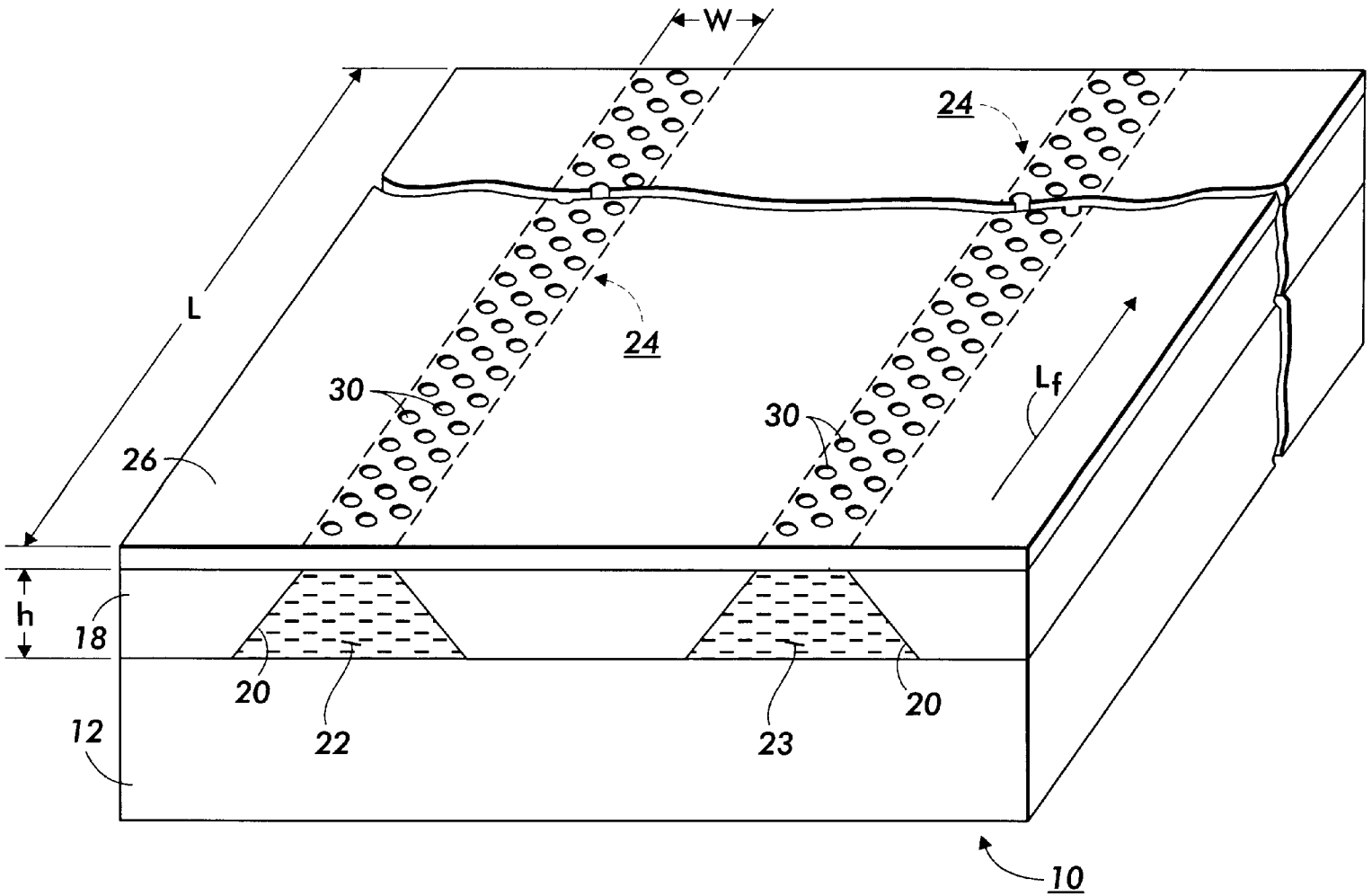
FIG. 2 PRIOR ART
FIG. 2 shows a perspective view of a prior art droplet emitter shown in FIG. 1.
Figure 4:
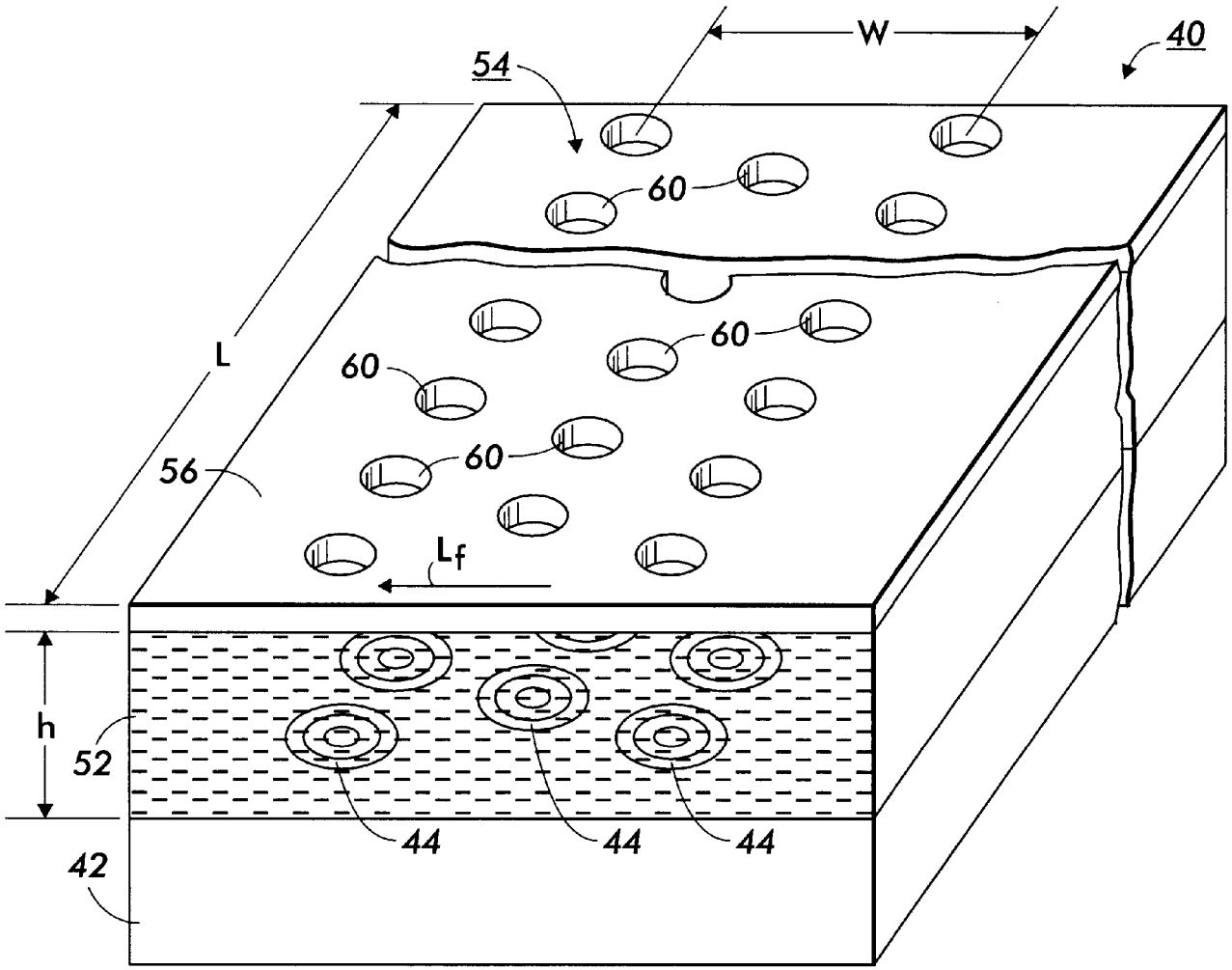
FIG. 4 shows a perspective view of the droplet emitter shown in FIG. 3.

FIG. 4 shows a perspective view of the droplet emitter 40 shown in FIG. 3. The array 54 of apertures 60 can be clearly seen on the liquid level control plate 56. Arrow Lf shows the flow direction of the flowing liquid 52 between the base substrate 42 and the liquid level control plate 56. Notice that the flow direction Lf is arranged such that the flowing liquid 52 flows along the shorter width W of the array 54 instead of along the longer length L of the array 54 as in FIGS. 1 and 2. In this configuration, the flow velocity of the liquid 52 is substantially independent of the distance between the sidewalls which define the channel. To further illustrate the point, notice in FIG. 2 that the length L of the array 24 and hence the length of the channel (the distance in the flow direction Lf) is much larger that the width W of the array 24 and hence the width of the channel (the distance transverse to the flow direction Lf). However, in FIG. 3, because the flow direction of the liquid has been rotated orthogonally to the length L of the array the distance in the flow direction Lf is much shorter. Therefore, as the array length increases, the flow rate and pressure loss along the flow direction is substantially independent of the array length, for the same flow velocities.

Much larger flow rates are achievable with this configuration. For instance, droplet emitters having a length L of 1.7 inches constructed with this configuration have sustained flow rates of 150 ml per minute with a differential meniscus position between the first and last emitter of 5 microns. These same printheads have also achieved flow rates of up to 300 ml per minute. These higher flow rates enable for instance the flowing liquid 52 to help maintain thermal uniformity of the droplet emitter 40. In particular, not only does the flowing liquid 52 itself have less opportunity to heat up due to excess heat generated during the acoustic emission process but because the flowing liquid 52 is in thermal contact with the substrate 42 the flowing liquid may also absorb excess heat generated in the substrate 42 during operation and prevent excess heating of the substrate 42 as well. In particular, printheads constructed as above tested at maximum emission rates with all emitters emitting at approximately 30 watts have shown a maximum instantaneous temperature differential between the first and last emitter of between approximately 2.9 degrees centigrade and 5 degrees centigrade. As can be readily appreciated, this is a large improvement over the performance of the prior art droplet emitter.

Figure 5:
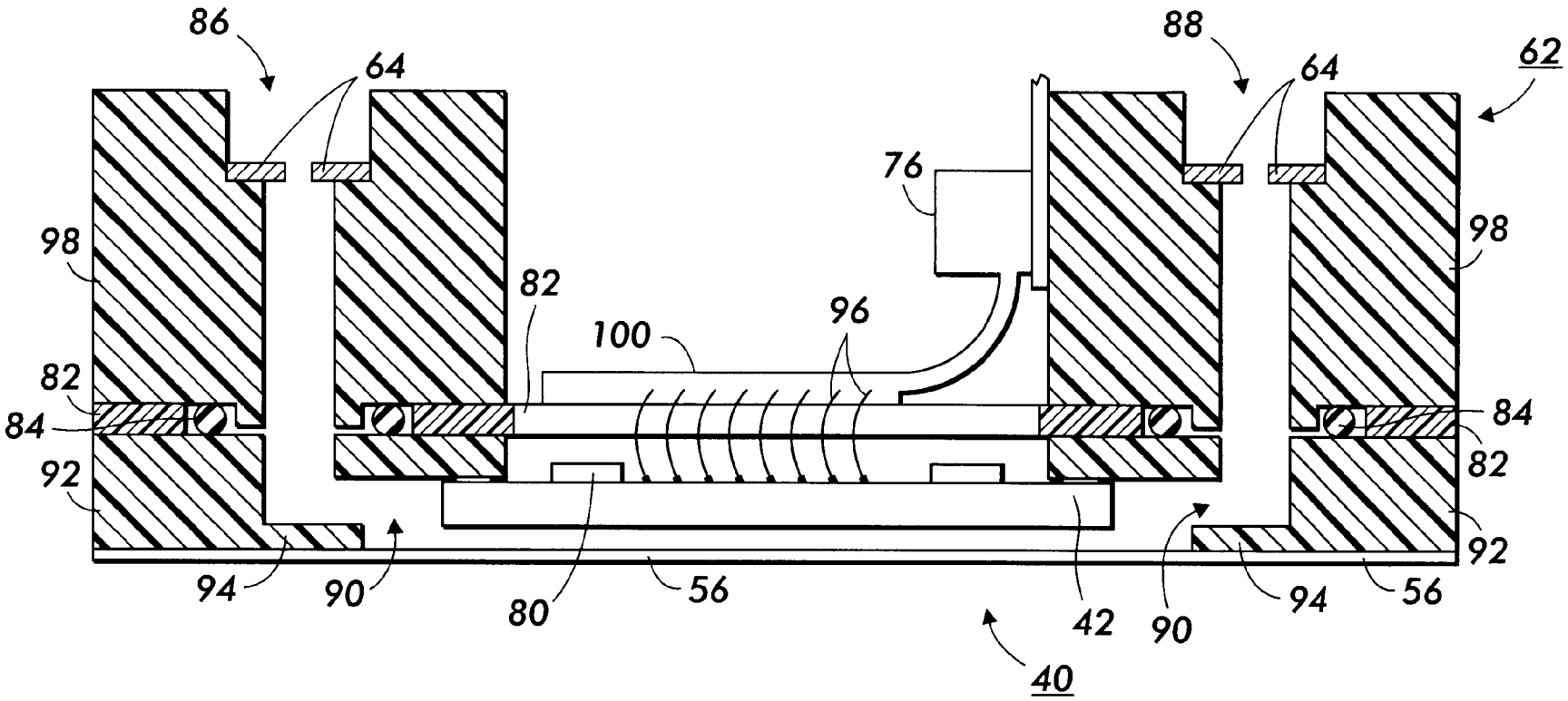
FIG. 5 shows a cross-sectional view of the droplet emitter shown in FIG. 3 with a fluid manifold attached.

FIG. 5 shows a cross-sectional view of how the droplet emitter of FIGS. 3 and 4 can be assembled with fluid manifold 62 to provide the flowing liquid 52 to the droplet emitter. While unitary contruction of the fluid manifold 62 may in some circumstances be desirable, in this implementation the fluid manifold 62 is divided into two portions, an upper manifold 98 and a lower manifold 92 with a flexible seal 84 therebetween.

The lower manifold 92, which is in direct contact with the base substrate 42 and the liquid level control plate 56, must be made from materials which have a thermal expansion coefficient relatively similar to the material the base substrate 42 is made from and preferably within a range of $+/-0.5\times10^{-6}$ per degree centigrade. This is primarily because the base sub strate 42 during the course of alignment to the lower manifold 92 and liquid level control plate 56 and subsequent bonding and curing steps may go through large temperature variations of up to 250 degrees centigrade and a differential thermal expansion of the parts of more than 5 microns can damage the assembly. The most common material for constructing the base substrate 42 is glass which has a thermal expansion coefficient of approximately $3.9\times10^{-6}$ per degree centigrade. Possible materials for constructing the lower manifold 92, when the base substrate 42 is made from glass, include alloy 42, Kovar, various ceramics and glass, which all have acceptable thermal expansion coefficients. However, as the length of the droplet emitter 40 increases, and hence the length of both the base substrate 42 and the liquid level control plate 56, either the allowable variation in thermal expansion coefficients, or the maximum temperature variation, or both must be correspondingly decreased.

Alloy 42, Kovar, ceramics and glass can be expensive and difficult to process therefore the upper manifold 98 is made of materials, such as inexpensive plastics, which have a different thermal expansion coefficient from glass and so are unsuitable for the lower manifold 92. The flexible seal 84 allows for a fluid seal between the upper manifold 98 and the lower manifold 92 while at the same time providing some give between the parts as they either expand or contract due to their different thermal expansion coefficients.

The lower manifold 92 has a liquid level control gap protrusion 94. The liquid level control plate 56 is attached a liquid level control gap protrusion 94. The liquid level control gap protrusion 94 is used to achieve a precise spacing between the base substrate 42 and the liquid level control plate 56 when the parts are assembled into the droplet emitter 40 and attached to the lower manifold 92.

The assembly of the droplet emitter 40 and attachment to the fluid manifold 62 creates a liquid sheet flow chamber 90 starting at the manifold inlet 86, proceeding through the gap between the base substrate 42 and the liquid level control plate 56 and ending at the manifold outlet 88. Both the manifold inlet 86 and the manifold outlet 88 have a sheet flow partition 64 which creates and maintains a sheet flow of the liquid flowing through the liquid sheet flow chamber 90.

Figure 6:
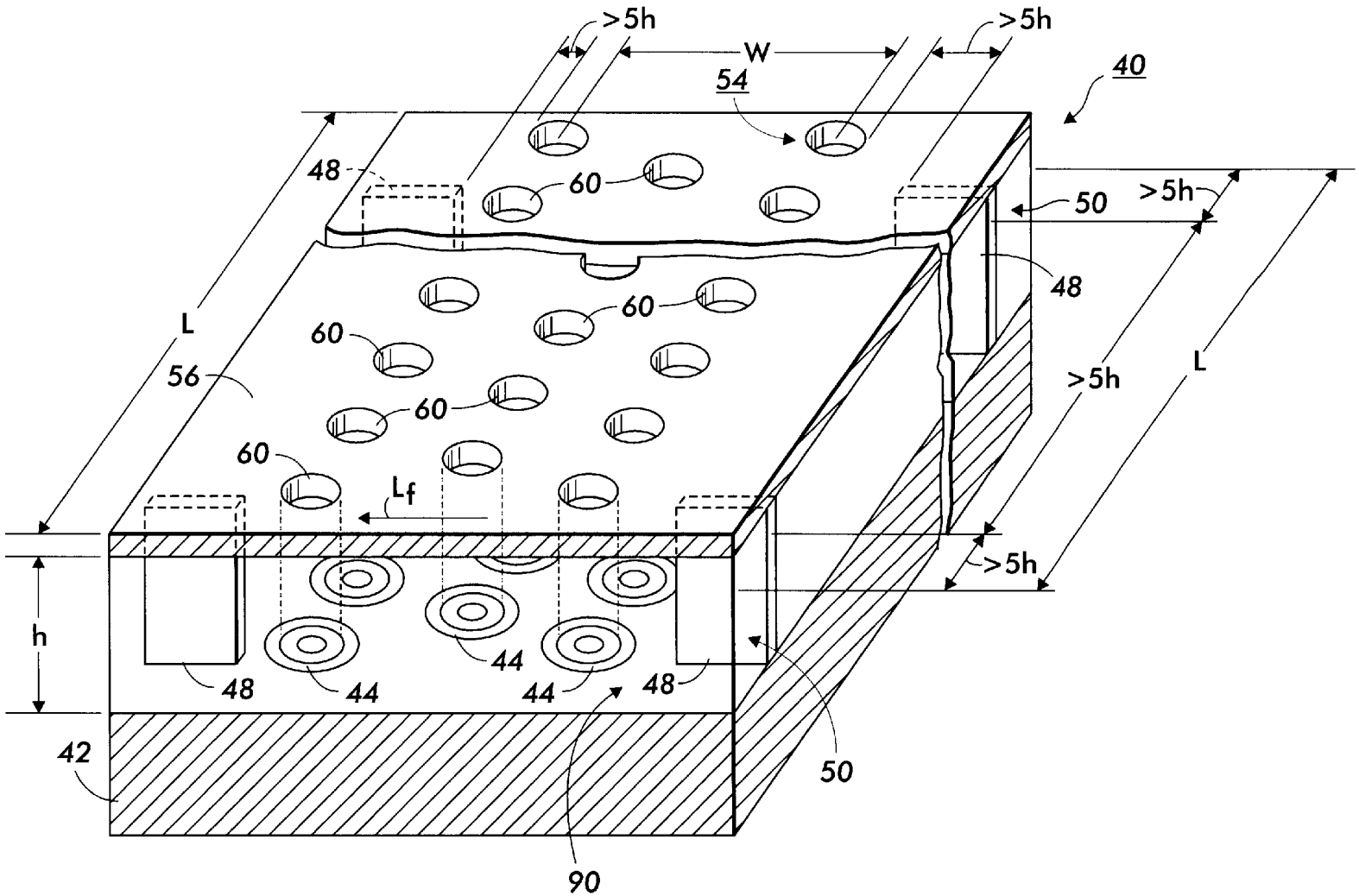
FIG. 6 shows a perspective view of the droplet emitter shown in FIG. 4 with the addition of liquid level control plate supports.

It should be noted that in the embodiments shown in FIGS. 3, 4, and 5, the liquid sheet flow chamber 90 has no physical or structural obstructions in the path of the flow, particularly in the portion of the sheet flow chamber 90 between the base substrate 42 and the liquid level control plate 56. This is the preferred embodiment as it ensures a uniform flow velocity for all the emitters across the entire length of the array. Furthermore, this decreases the possibility of trapped air-bubbles created during filling of the printhead or by perturbations in the liquid flow 52 and allows for the rapid removal of air bubbles that may get introduced into the system. However, it should be noted that as the length L of the droplet emitter gets larger, it may be desirable to provide additional support to the liquid level control plate 56. Such liquid level control plate supports 48 may be placed within the liquid flow chamber 90 provided that have a minimal footprint and are placed a minimal distance of at least five times the channel height h from both the ends of the liquid flow channel 90 and each other as shown in FIG. 6. Additionally, the supports must also be spaced at least a distance of five times the channel height h from the apertures 60. Note that the liquid level control plate supports 48 are placed in the flow direction, effectively creating several large flow chambers 50 between the liquid level control plate supports 48 in the portion of the liquid sheet flow chamber 90 where they reside.

An additional part assembled with the lower manifold 92 and the droplet emitter stack 40 is a bridge plate 82. The bridge plate 82 is used to mount a flex cable 100. The flex cable 100 is used to provide connections for discrete circuit components 76 which are mounted on the flex cable 100 and are used to generate and control the focussed acoustic wave. Bond wires 96 provide electrical connections between the flex cable 100 and circuit chips 80 mounted on the base substrate 42. Control circuitry for the droplet emitter has described for instance in U.S. Pat. No. 5,786,722 by Buhler et al. titled "Integrated RF Switching Cell Built In CMOS Technology And Utilizing A High Voltage Integrated Circuit Diode With A Charge Injecting Node" issued Jul. 28, 1998 or U.S. Pat. No. 5,389,956 by Hadimioglu et al. titled "Techniques For Improving Droplet Uniformity In Acoustic Ink Printing" issued Feb. 14, 1995 both incorporated by reference hereinabove.

Figure 7:
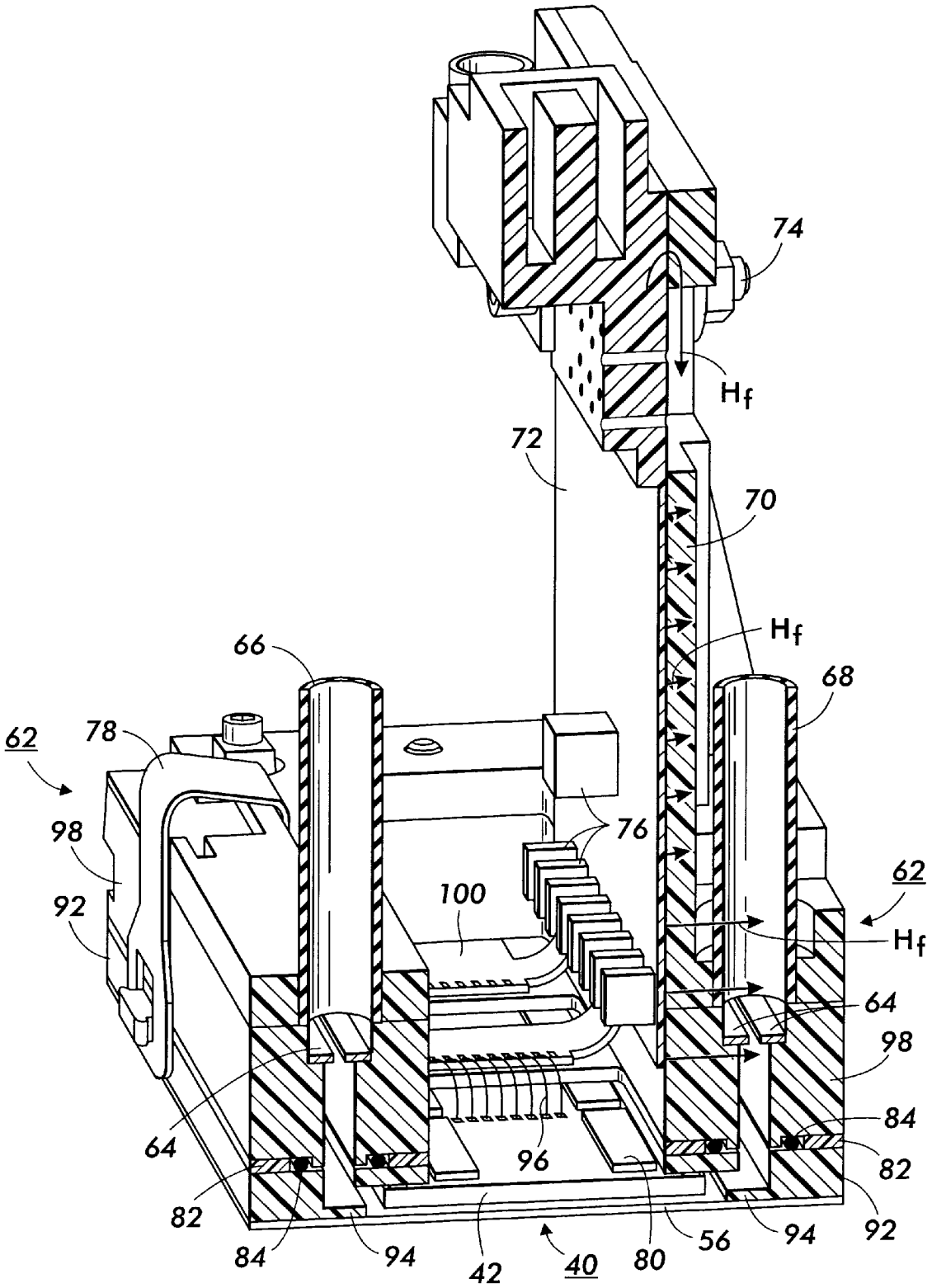
FIG. 7 shows a perspective view of cross-sectional view of the droplet emitter shown in FIG. 5 with additional thermally conductive components.

FIG. 7 shows a perspective view of the cross section of the droplet emitter shown in FIG. 5 with additional thermally conductive components. Specifically, a heat conductive backplane is inserted in the gap between the flex cable 100 and the manifold 62. Additionally, a thermally conductive connection 74 is made between the heat conductive back plane 72 and the upper manifold 98. The thermal conduction between the heat conductive backplane 72 and the manifold 62 allows heat generated by the circuit chips 80 to be transferred to the flowing liquid 52 via the manifold 62. It should be noted that the assembly is arranged such that the excess heat is transferred to the flowing liquid 52 on the exit portion of the device or after the flowing liquid 52 has passed through most of the liquid sheet flow chamber 90 and is ready to exit the manifold 62 through the manifold outlet tube 68. This allows excess heat to be carried away from the droplet emitter 40 and helps to maintain thermal uniformity within the droplet emitter 40.

Figure 8:
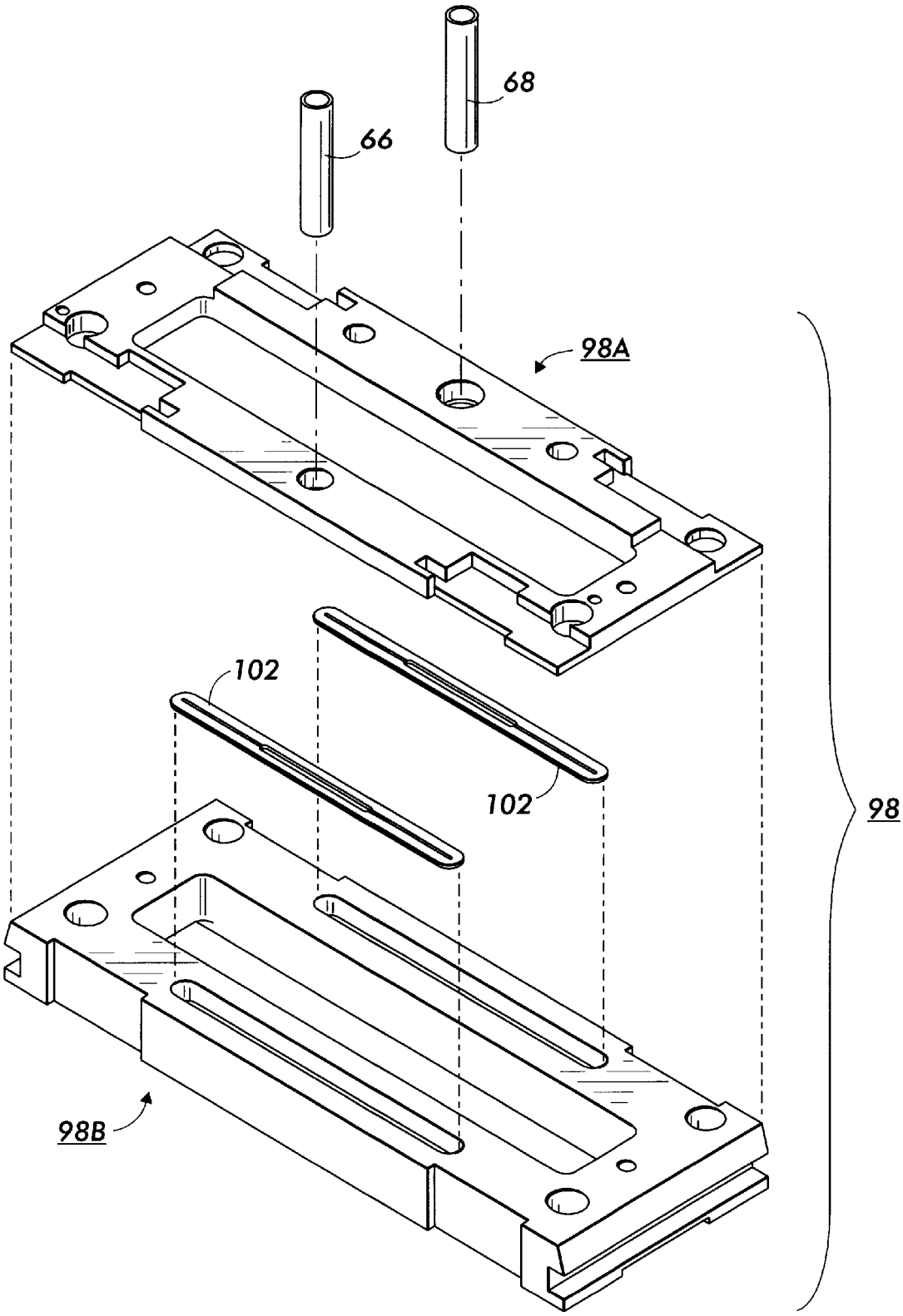
FIG. 8 shows an exploded view of the parts used to assemble an upper manifold.

Another feature shown in FIG. 7 is spring clip 78. The spring clip 78 is used to secure the entire assembly but allows for some movement of upper manifold 98 relative to the lower manifold 92 due to the different thermal expansion coefficients of the upper manifold 98 and the lower manifold 92. However, other fastening methods that would accomplish the same function are also known, For instance, the upper manifold 98 could be attached to the lower manifold 92 with an elastomer glue joint. An elastomer glue joint would fixedly attach the upper manifold 98 to the lower manifold 92 while also allowing for some movement of the upper manifold 98 relative to the lower manifold 92 due to the different thermal expansion coefficients. However, when spring clips 78 are used, their number and position should be such that the flexible seal is leak free and the seal force is uniformly distributed along the length L of the array 54 of the droplet emitter 40 in order to minimize gap deformations between the base substrate 42 and the liquid level control plate 56. In order to accomplish this, it should be noted that the two flexible seals 84, in the embodiment shown in FIG. 7 are two elongated O-rings. The compliance or stiffness of this type of O-ring seal is fairly uniform along the length of the O-ring except for the ends of the O-ring. This type of O-ring is much stiffer at the ends than along the rest of the length of the O-ring. Therefore, in order to insure that the seal force is distributed evenly over the length of the seal, or that the seal is under substantially uniform compression, more force is needed at the ends of the O-ring than along the rest of the length of the O-ring. One method of accomplishing this is to do as shown in FIG. 8, and place the spring clips 78 over the stiffer ends of the O-rings. However, this is not the only method available, for instance, a full lengthwise spring clip which applies more clamping force above the ends of the O-ring than along the rest of the length of the O-ring could be used. Also, a series of small spring clips applying a small force could be placed along the length of the O-ring while using larger spring clips which apply a greater force at the ends of the O-ring.

Figure 9:
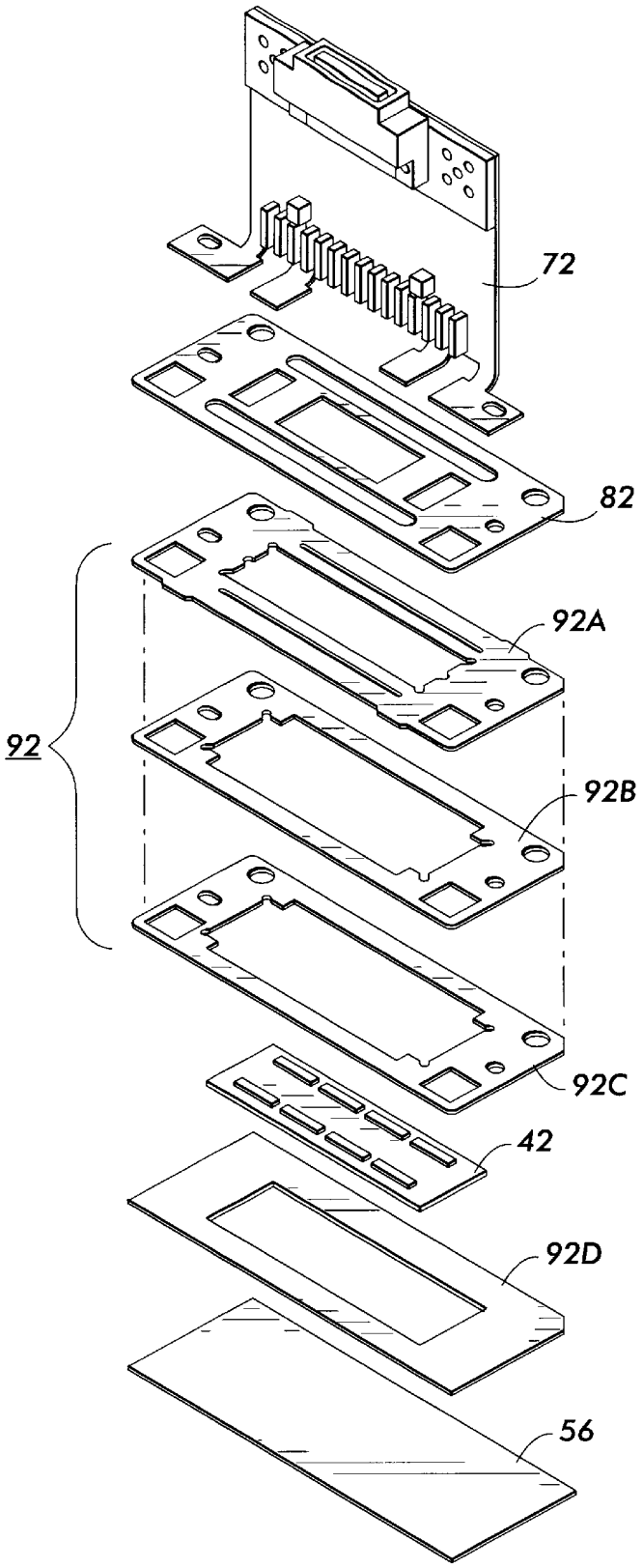
FIG. 9 shows an exploded view of the parts used to assemble a droplet emitter with a lower manifold and flex circuitry.

FIGS. 8 and 9 show exploded views of the upper manifold 98 and the lower manifold 92 respectively. Again, while many manufacturing techniques are known, one method to make the upper manifold 98 is to divide the upper manifold into easily manufacturable components which can then be assembled into the upper manifold. The upper manifold is divided into an upper portion 98*a* and a lower portion 98*b* which are then assembled with a pair of baffles 102 which is inserted therebetween. The baffles 102 are used to aide in the conversion of the liquid flow into the upper manifold 98 in a sheet flow. The manifold inlet and outlet tubes 66, 68 can then be inserted into the upper portion 98*a* to complete assembly of the upper manifold 98.

The lower manifold 92 can be assembled from a stack of parts in a similar manner along with the flex cable 72, base substrate 42, and the liquid level control plate 56. The lower manifold 92 is manufactured in four sheet-like portions 92*a*, 92*b*, 92*c*, and 92*d*. This allows for easy manufacture of the lower manifold 92 because each portion can be easily and accurately stamped, chemically etched or laser cut out of a sheet material such as readily available sheet metal stock. The liquid sheet flow chamber is defined by the patterns removed out of each portion 92*a*, 92*b*, 92*c*, 92*d* when the portions are stacked and assembled together with the base substrate 42, and the liquid level control plate 56.

What is claimed is:

1. A droplet emitter array comprising:

a) a first substrate having a thermal expansion coefficient being so arranged and constructed to provide a two-dimensional array of focussed acoustic waves, the array of focussed acoustic waves having at least two rows extending in a row direction and at least two columns extending in a column direction wherein the row direction is transverse to the column direction, and a length and a width wherein the length is greater than the width, b) a second substrate, having a thermal expansion coefficient, being spaced from the first substrate, the second substrate having a two-dimensional array of apertures, the array of apertures having at least two rows extending in a row direction and at least two columns extending in a column direction wherein the row direction is transverse to the column direction and, the second substrate being arrange relative to the first substrate such that each aperture may receive focussed acoustic waves from the first substrate wherein the space between the first and second substrates forms at least a portion of a liquid flow chamber having an inlet and an outlet which have been adapted to receive a flow of a liquid such that a free surface of the liquid is formed by each of the apertures in the second substrate, the focussed acoustic waves received by each aperture are focussed substantially at the free surface of the liquid formed in the aperture, and the flow of liquid flows sequentially in through the inlet, past substantially all of the array of apertures, and out through the outlet wherein at least a portion of the flow of liquid flows laminarly in substantially the width direction.

2. A droplet emitter array comprising:

a) a first substrate having a thermal expansion coefficient being so arranged and constructed to provide two-dimensional array of focussed acoustic waves, the array of focussed acoustic waves having at least two rows extending in a row direction and at least two columns extending in a column direction wherein the row direction is transverse to the column direction a length and a width with an associated width direction, wherein the length is greater than the width, b) a second substrate being spaced from the first substrate, the second substrate having a two-dimensional array of apertures, the array of apertures having at least two rows extending in a row direction and at least two columns extending in a column direction wherein the row direction is transverse to the column direction, the second substrate being arrange relative to the first substrate such that each aperture may receive focussed acoustic waves from the first substrate, and c) a liquid flow chamber at least partially interposed between the first and second substrates, the liquid flow chamber having an inlet and an outlet and being so constructed and arranged to receive a flow of a liquid such that a free surface of the liquid is formed by each of the apertures in the second substrate, the focussed acoustic waves received by each aperture are focussed substantially at the free surface of the liquid formed in the aperture, and the flow of liquid flows sequentially in through the inlet, past substantially all of the array of apertures, and out through the outlet and at least a portion of the flow of liquid flows in substantially the width direction.

3. The droplet emitter of claim 2 further comprising circuitry for generating and controlling the focussed acoustic waves wherein said circuitry is thermally connected to the liquid flow chamber for transferring heat from said circuitry to the flow of liquid before the flow of liquid leaves the liquid flow chamber.

4. The droplet emitter of claim 3 wherein said circuitry is thermally connected to the outlet of the liquid flow chamber for transferring heat to the flow of liquid after the flow of liquid has passed the array of apertures but before leaving the liquid flow chamber.

5. The droplet emitter of claim 2 wherein the first substrate further comprises:

a) an array of transducers for generating acoustic waves, and b) an array of focussing devices so arranged to receive the generated acoustic waves and to focussing the received acoustic waves substantially at the free surface of the liquid formed in the apertures.

6. The droplet emitter of claim 2 further comprising a fluid manifold having an inlet, an outlet, and a thermal expansion coefficient so constructed and arranged for receiving the flow of liquid in the inlet and providing a laminar flow of liquid to said liquid flow chamber through the outlet.

7. The droplet emitter of claim 6 wherein at least a portion of the fluid manifold is made from a material having a thermal expansion coefficient within $+/-0.5\times10^{-6}$ per degree centigrade of the thermal expansion coefficient of the first substrate and the thermal expansion coefficient of the second substrate.

8. The droplet emitter of claim 7 wherein at least a portion of the fluid manifold is made from a material having a thermal expansion coefficient substantially the same as the thermal expansion coefficient of the first substrate.

9. The droplet emitter of claim 6 wherein a first portion of the fluid manifold is made from a material having a thermal expansion coefficient within $+/-0.5\times10^{-6}$ per degree centigrade of the thermal expansion coefficient of the first substrate and a second portion of the fluid manifold is made from a material having a thermal expansion coefficient substantially different from the thermal expansion coefficient of the first substrate and further comprising a fluidic seal between the two portions.

10. The droplet emitter of claim 9 wherein the fluidic seal comprises a compressed O-ring seal, having a compliance, wherein the compression is substantially uniform along the length of the seal.

11. The droplet emitter of claim 10 wherein the compression to the O-ring seal is supplied by at least one clamp.

12. The droplet emitter of claim 11 wherein the clamping force varies approximately proportionally to the compliance of the O-ring seal.

13. The droplet emitter of claim 9 wherein the fluidic seal comprises an elastomeric adhesive.

* * * * *